US005910476A

United States Patent [19]

Kinsman et al.

[11] Patent Number: 5,910,476

[45] Date of Patent: Jun. 8, 1999

[54] ABRASIVE-CONTAINING SOAP BARS

[75] Inventors: Donald V. Kinsman, Ft. Thomas, Ky.; Timothy J. Cassady, Hamilton; J. Matthew White, Morrow, both of Ohio

[73] Assignee: Henkel Corporation, Gulph Mills, Pa.

[21] Appl. No.: 08/868,462

[22] Filed: Jun. 3, 1997

Related U.S. Application Data

[60] Provisional application No. 60/021,039, Jul. 2, 1996.

[51] Int. Cl.[6] ..... C11D 9/32; C11D 7/02; C11D 7/08; C11D 17/00

[52] U.S. Cl. ..... 510/447; 252/141; 252/142; 252/121

[58] Field of Search ..... 514/24, 25, 557, 514/558, 529, 579, 613, 616; 252/121, 117, 114, 113, 142, 164, 141; 510/447

[56] References Cited

U.S. PATENT DOCUMENTS

| | | | |
|---|---|---|---|
| 4,574,053 | 3/1986 | Kinsman et al. | 252/134 |
| 5,227,086 | 7/1993 | Kacher et al. | 252/112 |
| 5,254,281 | 10/1993 | Pichardo et al. | 252/108 |
| 5,264,144 | 11/1993 | Moroney et al. | 252/117 |
| 5,264,145 | 11/1993 | French et al. | 252/117 |
| 5,340,492 | 8/1994 | Kacher et al. | 252/112 |
| 5,389,279 | 2/1995 | Au et al. | 252/108 |
| 5,425,892 | 6/1995 | Taneri et al. | 252/134 |
| 5,510,049 | 4/1996 | Connor et al. | 252/108 |
| 5,607,980 | 3/1997 | McAtee et al. | 514/476 |
| 5,720,961 | 2/1998 | Fowler et al. | 424/401 |

*Primary Examiner*—Jose' G. Dees
*Assistant Examiner*—Alton Pryor
*Attorney, Agent, or Firm*—Wayne C. Jaeschke; John E. Drach; Steven J. Trzaska

[57] ABSTRACT

A soap bar useful for removing heavy amounts of soil from the skin is comprised of a fatty acid soap, a fatty acid ester of an isethionate salt, a nonionic sugar surfactant selected from the group consisting of an alkyl glucose ester, an aldobionamide, a gluconamide, a glyceramide, a glyceroglycolipid, a polyhydroxy fatty acid amide, an alkyl polyglycoside, and combinations thereof, an abrasive and, water.

10 Claims, No Drawings

ABRASIVE-CONTAINING SOAP BARS

BENEFIT OF EARLIER FILING DATE UNDER 37 CFR 1.78(a)(4)

This application claims the benefit of earlier filed and copending provisional application Ser. No. 60/021,039, filed on Jul. 2, 1996, the entire contents of which are incorporated herein by reference.

BACKGROUND OF THE INVENTION

1. Field of the Invention

This invention relates to soap bars containing sugar surfactants and abrasives. More specifically, the present invention relates to soap bars containing sugar surfactants and abrasives.

2. Description of the Related Art

Soap in bar form has long been in use for cleansing purposes. Those skilled in the art use the term soap to designate the reaction product of a carboxylic acid with a base, typically a metal hydroxide or carbonate. The resulting salt has both a polar hydrophilic end and a non-polar lipophilic end which facilitates the removal of oils and other non-polar materials from the skin or other surface in the presence of water.

Bar soaps are customarily prepared either by framing/casting or by refining/plodding. Framed cast soaps are prepared by reacting an appropriate fat, oil or carboxylic acid with a base in the presence of water to form soap, pouring the molten soap containing about 30% water into a frame or a mold, allowing the soap to cool and harden, and removing the soap having about 20% to 25% water by weight in a bar form. Those skilled in the soap-making art are aware that the carboxylic acid hereafter referred to as a fatty acid is readily available as an article of commerce. The fatty acid also can be obtained from a fat, such as tallow or lard, from an oil, such as coconut oil, palm oil, palm kernel oil, or olive oil, or from combinations of fats and oils. Fats and oils are comprised in substantial part of glycerides of varying chain lengths, which are esters of glycerol (glycerine) and fatty acids. Under alkaline conditions, and in the presence of heat, the glycerides constituting the fats and oils break down to form fatty acid salts, also known as soaps, and glycerine.

Refined/plodded soap bars are produced by subjecting the neutralized soap to various finishing steps which alter the crystalline matrix of the soap from the omega phase, as formed in framed/cast soap bars, to the beta phase. A more detailed discussion may be found in Bailey's Industrial Oil And Fat Products, 4th ed., Vol. 1, p. 558 et seq. (1979). Prior to conversion the soap is first dried from a moisture level of approximately 30% to a level in the range of about 10% to about 14%. Next, the dried soap is generally sent to a simple paddle-type mixer where a variety of additives can be introduced. From this mixer the soap is then sent either directly to a refiner or optionally to a three-roll mill and then to the refiner. Both the refiner and the mill subject the soap to compression and an intense shearing action which tend to orient the soap crystals and convert the soap largely to the beta-phase. After refining, the soap is compressed into a dense, coherent form in a plodding operation which forms solid portions which are suitable for stamping into bars.

Soap bars useful for heavy duty personal cleansing such as for removing heavy soils such as oil, grease, clay and the like contain an abrasive such as pumice to mechanically assist the removal of such heavy soils. One drawback of these types of bars has been their poor lather characteristics, hand feel and skin care properties.

SUMMARY OF THE INVENTION

The present invention relates to a soap bar comprised of a fatty acid soap, a nonionic sugar surfactant selected from the group consisting of an alkyl glucose ester, an aldobionamide, a gluconamide, a glyceramide, a glyceroglycolipid, a polyhydroxy fatty acid amide, an alkyl polyglycoside, and combinations thereof, a fatty acid ester of an isethionate salt, an abrasive and, water. The soap bars according to the invention are useful for removing heavy amounts of soil from the skin.

DESCRIPTION OF THE PREFERRED EMBODIMENTS

Other than in the claims and in the operating examples, or where otherwise indicated, all numbers expressing quantities of ingredients or reaction conditions used herein are to be understood as modified in all instances by the term "about".

The fatty acid soap which can be used in the composition according to the invention is a salt of a coconut fatty acid. A typical coconut fatty acid is composed primarily of from 45% to 55% by weight lauric acid, from 15% to 23% by weight of myristic acid, from 8% to 11% of palmitic acid, from 1% to 10% by weight of stearic acid, from 1% to 14% of caprylic and capric acids, and from 1% to 8% by weight of oleic acid.

Preferably, the coconut fatty acid component will contain from 48% to 51% by weight lauric acid, from 18% to 20% by weight of myristic acid, from 9% to 10% of palmitic acid, from 6% to 8% by weight of stearic acid, from 1% to 3% by weight of oleic acid, and from 12% to 13% by weight of caprylic and capric acids. An example of a commercially available coconut fatty acid is EMERY® 625 Partially Hydrogenated Coconut Fatty Acid, a trademark product of Henkel Corporation, Emery Group, Cincinnati, Ohio, and which contained (average weight percent) 49% lauric acid, 19% myristic acid, 9% palmitic acid, 7% stearic acid, 7% caprylic acid, 6% capric acid, and 3% oleic acid. The coconut fatty acid soap can be formed by neutralizing a coconut fatty acid with sodium hydroxide or any base that will form a salt that can be used in a typical soap bar. The amount of fatty acid soap that can be used in the soap bars according to the invention can range from 30% to 55% by weight of the soap bar.

The nonionic sugar surfactant that can be used in the soap bars according to the invention include an alkyl glucose ester, an aldobionamide, a gluconamide, a glyceramide, a glyceroglycolipid and a polyhydroxy fatty acid amide surfactant, and an alkyl polyglycoside each of which is described more fully hereinbelow.

The alkyl glucose ester sugar surfactants are generally disclosed in U.S. Pat. Nos. 5,109,127 and 5,190,747 the entire contents of both of which are incorporated herein by reference. These surfactants have the general formula I:

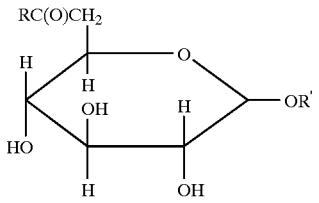

wherein R represents a fatty acid residue of 6 to 20 carbon atoms, preferably 6 to 12 carbon atoms and $R^1$ represents an alkyl group having 2 to 6 carbon atoms. Representative examples of such alkyl glucose esters are 1-ethyl-6-caprylglucoside, 1-ethyl-6-laurylglucoside, 1-butyl-6-caprylglucoside, 1-ethyl-6-palmitylglucoside and 1-ethyl-6-oleylglucoside.

The aldobionamide sugar surfactants are generally disclosed in U.S. Pat. No. 5,310,542 and in published European Patent Application No. 550,281 both of which are incorporated herein by reference. An aldobionamide is generally defined as the amide of an aldobionic acid or aldobionolactone and an aldobionic acid in turn is defined as a sugar substance (e.g. any cyclic sugar) in which the aldehyde group has been replaced by a carboxylic acid which upon drying is capable of cyclizing to form an aldonolactone. The aldobionamides can be based on compounds comprising two saccharide units, e.g. lactobionamides, maltobionamides, cellobionamides, melibionamides, or gentiobionamides, or they can be based on compounds comprising more than two saccharide units provided that the polysaccharide has a terminal sugar unit with an aldehyde group available.

The preferred aldobionamides of the present invention are lactobionamides of the formula II:

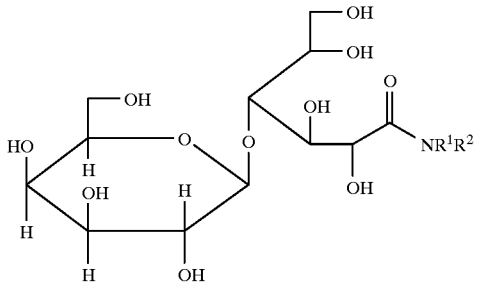

wherein $R^1$ and $R^2$ are the same or different and are selected from hydrogen and an aliphatic hydrocarbon radical containing up to about 36 carbon atoms (e.g. alkyl groups and alkenyl groups which groups may also include a heteroatom such as N, O, S, present, for instance, as an amide, carboxy, ether and/or saccharide moiety) except that $R^1$ and $R^2$ cannot simultaneously be hydrogen. The aliphatic hydrocarbon radical preferably contains up to 24 carbon atoms, most preferably from 8 to 18 carbon atoms. Representative examples of such lactobionamides are N-propyl lactobionamide, N-pentyl lactobionamide, N-decyl lactobionamide, N-hexadecyl lactobionamide, N-oleyl lactobionamide, N-dodecyl-N-methyl lactobionamide, and N-dodecyloxypropyl lactobionamide.

The gluconamide sugar surfactants are generally disclosed in U.S. Pat. No. 5,352,386 the entire contents of which is incorporated herein by reference. These have the general formula III:

$$HOCH_2—(CHOH)_m—C(O)—NHR$$

wherein m is an integer from 2 to 5; and R is a straight or branched, saturated or unsaturated aliphatic hydrocarbon having 4 to about 24 carbon atoms, preferably 8 to 24 carbon atoms, which R group can also contain a heteroatom selected from the group consisting of oxygen, nitrogen and sulfur. Representative examples of such are N-octylerythronamide, N-decylerythronamide, N-dodecylerythronamide, N-tetradecylerythronamide, N-decylxylonamide and N-dodecylxylonamide.

The glyceramide sugar surfactants are generally disclosed in U.S. Pat. No. 5,352,387, the entire contents of which are incorporated herein by reference.

These surfactants have the general formula:

$$HOCH_2CH(OH)C(O)NHR$$

wherein R is a $C_8$ to $C_{24}$ straight or branched chained, saturated or unsaturated aliphatic hydrocarbon in which the R group may also be substituted by a heteroatom selected from oxygen, nitrogen and sulfur. Representative examples of such surfactants are N-octylglyceramide, N-decylglyceramide and N-hexadecylglyceramide.

The glyceroglycolipid sugar surfactants are generally disclosed in U.S. Pat. No. 5,358,656, and published European Patent Application No. 550,279, the disclosure of each of which is incorporated herein by reference. The glyceroglycolipids can be of the formula IV:

$$A^1—O—CH_2—CH(B)—CH_2NRR_1$$

wherein $A^1$ is a saccharide, preferably having one or more saccharide units, more preferably a mono or disaccharide and most preferably a monosaccharide such as glucose or galactose; R and $R_1$ are the same or different and are hydrogen, a branched or unbranched hydrocarbon radical having from 1 to about 24, preferably from about 6 to about 18 carbon atoms; B is OH or a $NR^2R^3$ group, wherein $R^2$ and $R^3$ may be the same or different and are hydrogen, a branched or unbranched hydrocarbon radical having 1 to 24, preferably from 6 to 18 carbon atoms, and $NRR_1$ and B are positionally interchangeable. Representative examples of such surfactants are 3-(butylamino)-2-hydroxypropyl-β-D-galactopyranoside, 3-(octylamino)-2-hydroxypropyl-β-D-galactopyranoside, 3-(eicosylamino)-2-hydroxypropyl-β-D-galactopyranoside, 3-(butylamino)-2-hydroxypropyl-β-D-glucopyranoside, and 3-(pentylamino)-2-hydroxypropyl-β-D-mannopyranoside.

Other glyceroglycolipid surfactants are disclosed in published European Patent Application No. 550,280 which is incorporated herein by reference. These surfactants are of the formula:

$$A^1—O—CH_2—CH(OR_1)—CH_2OR$$

wherein $A^1$ is from 1 to 4 saccharide units and more preferably represents a mono or disaccharide, and most preferably a monosaccharide, for example, glucose or galactose; R and $R_1$ are the same or different and are hydrogen, or a branched or unbranched, saturated or unsaturated, hydrocarbon radical having from 1 to 24 carbon atoms, preferably from 6 to 18 carbon atoms. Representative examples of such surfactants are 3-(butyloxy)-2-hydroxypropyl-β-D-galactopyranoside, 3-(eicosyloxy)-2-hydroxypropyl-β-D-galactopyranoside, 3-(decyloxy)-2-hydroxypropyl-β-D-galactopyranoside, 3-(butyloxy)-2-hydroxypropyl-β-D-glucopyranoside, 3-(octyloxy)-2-hydroxypropyl-β-D-mannopyranoside, 3-(tetradecyloxy)-2-hydroxypropyl-β-D-lactoside, 3-(octadecyloxy)-2-hydroxypropyl-β-D-maltoside, 3-(octyloxy)-2-hydroxypropyl-β-D-galactotrioside, and 3-(dodecyloxy)-2-hydroxypropyl-β-D-cellotrioside.

The polyhydroxy fatty acid amide sugar surfactants are generally disclosed in U.S. Pat. Nos. 5,174,927, 5,223,179 and 5,332,528 the entire disclosure of each of which is incorporated herein by reference. The polyhydroxy fatty acid amide surfactant component of the present invention comprises compounds of the structural formula V:

$$R^2C(O)N(R^1)Z$$

wherein: $R^1$ is H, $C_1$–$C_4$ hydrocarbyl, 2-hydroxy ethyl, 2-hydroxy propyl or a mixture thereof, preferably $C_1$–$C_4$ alkyl, more preferably $C_1$ or $C_2$ alkyl, most preferably $C_1$ alkyl (i.e., methyl); and $R^2$ is a $C_5$–$C_{31}$ hydrocarbyl, preferably straight chain $C_7$–$C_{19}$ alkyl or alkenyl, more preferably straight chain $C_9$–$C_{17}$ alkyl or alkenyl, most preferably straight chain $C_{11}$–$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)n—CH_2OH$, $—CH(CH_2OH)—(CHOH)_{n-1}—CH_2OH$, $—CH_2—(CHOH)_2(CHOR')(CHOH)—CH_2OH$, where n is an integer from 3 to 5, inclusive, and R' is H or a cyclic or aliphatic monosaccharide, and alkoxylated derivatives thereof. Most preferred are glycityls wherein n is 4, particularly $—CH_2—(CHOH)_4—CH_2OH$.

In the above Formula $R^1$ can be, for example, N-methyl, N-ethyl, N-propyl, N-isopropyl, N-butyl, N-2-hydroxy ethyl, or N-2-hydroxy propyl. $R^2C(O)N<$can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc. Representative examples of such cosurfactants are N-methyl-N-1-deoxyglucityl cocoamide and N-methyl-N-1-deoxyglucityl tallowamide.

Other suitable polyhydroxy fatty acid amide surfactants (see U.S. Pat. Nos. 5,223,179 and 5,338,491, the entire contents of each which are incorporated herein by reference) are those of the formula VI:

$$RC(O)N(R^1)CH_2CH(OH)CH_2OH$$

wherein R is a $C_7$–$C_{21}$ hydrocarbyl species, i.e. coconut, tallow, palm fatty alkyl and oleyl, and $R^1$ is a $C_1$ to $C_6$ hydrocarbyl or substituted hydrocarbyl species, i.e. N-alkyl-N-(1,2-propanediol) and N-hydroxyalkyl-N-1,2-propane diol fatty acid amides. Representative examples of such cosurfactants are the tallow amide of 3-[2-(hydroxyethyl) amino]-1,2-propanediol (HEAPD), the palmitate amide of 3-methylamino-1,2-propanediol (MAPD) and the lauramide of MAPD.

The alkyl polyglycoside surfactants are compounds of the formula VII:

$$R_1O(R_2O)_b(Z)_a$$

wherein $R_1$ is a monovalent organic radical having from about 6 to about 30 carbon atoms; $R_2$ is divalent alkylene radical having from 2 to 4 carbon atoms; Z is a saccharide residue having 5 or 6 carbon atoms; b is a number having a value from 0 to about 12; a is a number having a value from 1 to about 6. Preferred alkyl polyglycosides which can be used in the compositions according to the invention have the formula VII wherein Z is a glucose residue and b is zero. Such alkyl polyglycosides are commercially available, for example, as APG®, GLUCOPON®, or PLANTAREN®, surfactants from Henkel Corporation, Ambler, Pa., 19002. Examples of such surfactants include but are not limited to:

1. GLUCOPON® 225 Surfactant—an alkyl polyglycoside in which the alkyl group contains 8 to 10 carbon atoms and having an average degree of polymerization of 1.7.
2. GLUCOPON® 425 Surfactant—an alkyl polyglycoside in which the alkyl group contains 8 to 16 carbon atoms and having an average degree of polymerization of 1.55.
3. GLUCOPON® 625 Surfactant—an alkyl polyglycoside in which the alkyl group contains 12 to 16 carbon atoms and having an average degree of polymerization of 1.6.
4. APG® 325 Surfactant—an alkyl polyglycoside in which the alkyl group contains 9 to 11 carbon atoms and having an average degree of polymerization of 1.6.
5. GLUCOPON® 600 Surfactant—an alkyl polyglycoside in which the alkyl group contains 12 to 16 carbon atoms and having an average degree of polymerization of 1.4.
6. PLANTAREN® 2000 Surfactant—a $C_{8-16}$ alkyl polyglycoside in which the alkyl group contains 8 to 16 carbon atoms and having an average degree of polymerization of 1.4.
7. PLANTAREN® 1300 Surfactant—a $C_{12-16}$ alkyl polyglycoside in which the alkyl group contains 12 to 16 carbon atoms and having an average degree of polymerization of 1.6.

Other examples include alkyl polyglycoside surfactant compositions which are comprised of mixtures of compounds of formula VII wherein Z represents a moiety derived from a reducing saccharide containing 5 or 6 carbon atoms; a is a number having a value from 1 to about 6; b is zero; and $R_1$ is an alkyl radical having from 8 to 20 carbon atoms. The compositions are characterized in that they have increased surfactant properties and an HLB in the range of about 10 to about 16 and a non-Flory distribution of glycosides, which is comprised of a mixture of an alkyl monoglycoside and a mixture of alkyl polyglycosides having varying degrees of polymerization of 2 and higher in progressively decreasing amounts, in which the amount by weight of polyglycoside having a degree of polymerization of 2, or mixtures thereof with the polyglycoside having a degree of polymerization of 3, predominate in relation to the amount of monoglycoside, said composition having an average degree of polymerization of about 1.8 to about 3. Such compositions, also known as peaked alkyl polyglycosides, can be prepared by separation of the monoglycoside from the original reaction mixture of alkyl monoglycoside and alkyl polyglycosides after removal of the alcohol. This separation may be carried out by molecular distillation and normally results in the removal of about 70–95% by weight of the alkyl monoglycosides. After removal of the alkyl monoglycosides, the relative distribution of the various components, mono- and poly-glycosides, in the resulting product changes and the concentration in the product of the polyglycosides relative to the monoglycoside increases as well as the concentration of individual polyglycosides to the total, i.e. DP2 and DP3 fractions in relation to the sum of all DP fractions. Such compositions are disclosed in U.S. Pat. No. 5,266,690, the entire contents of which are incorporated herein by reference.

Other alkyl polyglycosides which can be used in the compositions according to the invention are those in which the alkyl moiety contains from 6 to 18 carbon atoms in which the average carbon chain length of the composition is from about 9 to about 14 comprising a mixture of two or more of at least binary components of alkyl polyglycosides, wherein each binary component is present in the mixture in relation to its average carbon chain length in an amount effective to provide the surfactant composition with the average carbon chain length of about 9 to about 14 and wherein at least one, or both binary components, comprise a Flory distribution of polyglycosides derived from an acid-catalyzed reaction of an alcohol containing 6–20 carbon atoms and a suitable saccharide from which excess alcohol has been separated.

Preferred nonionic sugar surfactants are alkyl polyglycosides as set forth above. The amount of sugar surfactant that can be used in the soap bars according to the invention can range from 0.5% to 10% by weight of the soap bar.

The fatty acid ester of an isethionate salt that can be used in the soap bars according to the invention is the sodium of ammonium salt of $C_{8-20}$ fatty acid ester of isethionic acid. Preferably, the isethionate will be the sodium salt of a fatty acid isethionate such as sodium cocoyl isethionate. Ammonium cocoyl isethionate is also preferred. The amount of isethionate salt that can be used in the soap bars according to the invention can range from 0.5% to 20% by weight of the soap bar.

The abrasive that can be used in the soap bars according to the invention can be any abrasive normally used in soap bars and which are well known to those skilled in the art. Preferably, the abrasive is pumice, talc, sand, or a combination thereof. The preferred abrasive is pumice. The amount of abrasive that can be used in the soap bars according to the invention can range from 10% to 30% by weight of the soap bar.

The amount of water that can be used in the soap bars according to the invention can range from 15% to 50% by weight of the soap bar.

The soap bars according to the invention are made by mixing sugar surfactant and the isethionate salt together to form a premix and the premix added to the sodium salt of the fatty acid which also contains the abrasive and water. The resulting mixture is then formed into a bar by any of the conventional methods known those skilled in the art framing/casting or refining/plodding.

The following example is meant to illustrate but not to limit the invention.

EXAMPLE 1

A Typical Soap Bar Composition

EMERY® 625—44.9%; Pumice—20.9%; GLUCOPON® 625 Surfactant—5.4%; sodium cocoyl isethionate—5.4%; Distilled water—23.8%.

What is claimed is:

1. A soap bar comprised of from about 30% to about 55% by weight of a fatty acid soap, from about 0.5% to about 20% by weight of a fatty acid ester of an isethionate salt, from about 0.5% to about 10% by weight of a nonionic sugar surfactant selected from the group consisting of an alkyl glucose ester, an aldobionamide, a gluconamide, a glyceramide, a glyceroglycolipid, a polyhydroxy fatty acid amide, an alkyl polyglycosice, and combinations thereof, from about 10% to about 30% by weight of an abrasive and, from about 15% to about 50% by weight of water.

2. The soap bar of claim 1 wherein said fatty acid soap is the sodium salt of coconut fatty acid.

3. The soap bar of claim 1 wherein said sugar surfactant is an alkyl polyglycoside.

4. The soap bar of claim 3 wherein said alkyl polyglycoside is an alkyl polyglycoside in which the alkyl group contains 12 to 16 carbon atoms and having an average degree of polymerization of 1.6.

5. The soap bar of claim 1 wherein said abrasive is pumice.

6. A soap bar made by the process which comprises the steps of: (1) forming a first mix by combining from about 30% to about 55% by weight of a fatty acid soap and from about 0.5% to about 20% by weight of a fatty acid ester of an isethionate salt; (2) adding said first mix added to a second mix comprised of from about 0.5% to about 10% by weight of a nonionic sugar surfactant selected from the group consisting of an alkyl glucose ester, an aldobionamide, a gluconamide, a glyceramide, a glyceroglycolipid, a polyhydroxy fatty acid amide, an alkyl polyglycoside, and combinations thereof, from about 10% to about 30% by weight of an abrasive and, from about 15% to about 50% be weight of water; (3) forming a soap bar from said soap mixture.

7. The soap bar of claim 6 wherein said fatty acid soap is the sodium salt of coconut fatty acid.

8. The soap bar of claim 6 wherein said sugar surfactant is an alkyl polyglycoside.

9. The soap bar of claim 8 wherein said alkyl polyglycoside is an alkyl polyglycoside in which the alkyl group contains 12 to 16 carbon atoms and having an average degree of polymerization of 1.6.

10. The soap bar of claim 6 wherein said abrasive is pumice.

* * * * *